United States Patent [19]

Moss, III et al.

[11] Patent Number: 5,015,259

[45] Date of Patent: May 14, 1991

[54] STAIN RESISTANT POLYMERIC COMPOSITION

[75] Inventors: Thomas H. Moss, III; Ralph R. Sargent; Michael S. Williams, all of Rome, Ga.

[73] Assignee: Peach State Labs, Inc., Rome, Ga.

[21] Appl. No.: 521,752

[22] Filed: May 10, 1990

Related U.S. Application Data

[62] Division of Ser. No. 341,774, Apr. 20, 1989, Pat. No. 4,940,757.

[51] Int. Cl.[5] ..... D06M 00/00; G08F 223/00; C08G 8/30; C08G 63/48

[52] U.S. Cl. ..... 8/115.6; 8/115.51; 525/402; 525/401; 525/502; 525/58

[58] Field of Search ..... 525/402, 401, 502, 58; 8/115.6, 115.51

[56] References Cited

U.S. PATENT DOCUMENTS

| | | | |
|---|---|---|---|
| 1,901,536 | 3/1933 | Schafer | 528/150 |
| 1,972,754 | 9/1934 | Biedermann | 528/150 |
| 1,988,985 | 1/1935 | Schafer | 528/150 |
| 2,112,361 | 3/1938 | Fischer | 528/150 |
| 2,171,806 | 9/1939 | Russell et al. | 528/150 |
| 2,581,390 | 1/1952 | De Groote et al. | 525/502 |
| 3,221,079 | 11/1965 | Harris | 528/150 |
| 3,481,890 | 12/1969 | Guldenpfennig | 260/20 |
| 3,691,118 | 9/1972 | Fishman | 260/19 |
| 3,843,576 | 10/1974 | Parkinson | 260/29.3 |
| 3,851,012 | 11/1974 | Wertz et al. | 260/845 |
| 4,187,383 | 2/1980 | Cowherd et al. | 560/224 |
| 4,501,591 | 2/1985 | Ucci et al. | 8/495 |
| 4,565,838 | 1/1986 | Paar et al. | 523/414 |
| 4,592,940 | 6/1986 | Blyth et al. | 428/96 |
| 4,680,212 | 7/1987 | Blyth et al. | 428/97 |
| 4,690,995 | 9/1987 | Keskey et al. | 525/66 |
| 4,739,002 | 4/1988 | Ishikawa et al. | 524/270 |
| 4,780,099 | 10/1988 | Greschler et al. | 8/115.6 |
| 4,822,373 | 4/1989 | Olson et al. | 8/115.6 |
| 4,839,212 | 6/1989 | Blyth et al. | 428/96 |
| 4,940,757 | 7/1990 | Moss, III et al. | 525/402 |

FOREIGN PATENT DOCUMENTS

| | | |
|---|---|---|
| 0235980 | 9/1987 | European Pat. Off. . |
| 0235989 | 9/1987 | European Pat. Off. . |
| 0267681 | 9/1987 | European Pat. Off. . |
| 0268374 | 10/1987 | European Pat. Off. . |
| 0329899 | 12/1988 | European Pat. Off. . |
| 0332342 | 3/1989 | European Pat. Off. . |
| 0328822 | 10/1989 | European Pat. Off. . |

OTHER PUBLICATIONS

Anton, A., *Text. Chem. Color*, 13, 45–50, (Feb., 1981).
Bolyacherskaya, K. I., et al., *Chem. Abstr.*, 107:7734d, (1987).
Carr, *Textile Horizons*, 43–44, (1988).
Chatterjee, S., *Chem. Abstr.*, 106:214512z, (1987).
Greschler, I., et al., *Chem. Abstr.*, 108:7466p, (1988).
Hanawa, T., *Chem. Abstr.*, 108:76525u, (1988).
IG-Technical Research, Inc., *Chem. Abstr.*, 102:204892b, (1985).
Jose, D. J., et al., *Canadian Textile Journal*, 105(11) 34–36, (Nov., 1988).
Kosicek et al., *Chem. Abstr.*, 99:196330u, (1983).
Kujas, E. F., *Chem. Abstr.*, 107:79373h, (1987).
Liss, T. A., *Chem. Abstr.*, 108:39601v, (1988).
Matsuo, A., et al., 104:336778a, (1986).
Matsushita Electric Works, Ltd., *Chem. Abstr.*, 95:82167h, (1981).
Minnesota Mining & Manufacturing Co., et al., *World Textiles Abstracts*, 5292, (1988).
Shima, T., et al., *Chem. Abstr.*, 14670c, (1974).
Venkataboopathy, L., et al., *Chem. Abstr.*, 99:124391s, (1983).

*Primary Examiner*—John C. Bleutge
*Assistant Examiner*—W. R. M. Clark
*Attorney, Agent, or Firm*—Kilpatrick & Cody

[57] ABSTRACT

A stain resistant composition for fibers having polyamide linkages prepared by polymerizing an α-substituted acrylic acid or ester in the presence of a sulfonated aromatic formaldehyde condensation polymer, and methods for making and applying the composition.

34 Claims, No Drawings

STAIN RESISTANT POLYMERIC COMPOSITION

This is a divisional of U.S. application Ser. No. 07/341,774 filed on Apr. 20, 1989, now allowed U.S. Pat. No. 4,940,757.

BACKGROUND OF THE INVENTION

This invention relates to stain resistant polymeric compositions for the treatment of natural and synthetic fibers containing polyamide linkages.

Nylon has had a dramatic effect on both industry and society since its discovery by W. H. Carothers more than fifty years ago. It is estimated that 75% of all carpet currently produced in the United States, and 46% of all carpet produced in Europe, is prepared from nylon fiber.

Nylon fiber is relatively inexpensive and offers a combination of desirable qualities such as comfort, warmth, and ease of manufacture into a broad range of colors, patterns and textures. However, nylon, as well as other polyamide fibers and fabrics, is easily stained by certain natural and artificial colorants such as those found in coffee, mustard, wine, and soft drinks.

Recently, fluorochemical coatings have been developed which prevent wetting of the carpet surface, minimizing chemical contact between the carpet surface and substances which can stain the carpet, making the substance easier to remove. Fluorochemicals also provide a physical barrier to staining material. Typical fluorochemicals contain a perfluoroalkyl radical having 3–20 carbons, and are produced by condensation of a fluorinated alcohol or fluorinated primary amine with a suitable anhydride or isocyanate, for example, N-ethyl perfluorooctyl-sulfonamidoethanol and toluene diisocyanate reacted in a 2:1 molar ratio.

Examples of commercially available fluorochemical coatings include Scotchgard TM 358 and 352 (Minnesota Mining & Mfg. Co.) and Zepel TM and Teflon TM (E. I. Du Pont Nemours & Co.). Antron Plus TM carpet manufactured by Du Pont contains nylon carpet fibers coated with fluorocarbons.

While fluorochemical coatings are effective in protecting carpet from substances such as soil, they offer little protection from stains resulting from acid dyes which are found in common household materials such as coffee, wine, mustard and soft drinks. Acid dyes are bases which bond to protonated amino sites in the polyamide fiber. A wide variety of methods have been developed to make fibers containing polyamide linkages more resistant to staining by acid dyes. The most widely used method involves the application to the polyamide fiber of a colorless formaldehyde phenol or naphthol condensation polymer which has sulfonate groups on the aromatic rings. The sulfonate groups bond to available protonated amino groups in the polyamide fiber, preventing the protonated amino groups from later bonding to common household acid dyes. The polymeric coating also protects the carpet fiber by creating a barrier of negative electric charge at the surface of the fiber that prevents like-charged acid dyes from penetrating the fiber.

Examples of phenol-formaldehyde condensation polymers are described in U.S. Pat. Nos. 4,501,591, 4,592,940 and 4,680,212 to Ucci and Blythe. In particular, U.S. Pat. Nos. 4,592,940 and 4,680,212 describe a formaldehyde condensation product formed from a mixture of sulfonated dihydroxydiphenylsulfone and phenylsulphonic acid, wherein at least 40% of the repeating units contain an $—SO_3X$ radical, and at least 40% of the repeating units are dihydroxydiphenylsulfone.

Sulfonated hydroxyaromatic formaldehyde condensation products marketed as stain resistant agents include Erinol TM NW (Ciba-Geigy Limited), Intratex N TM (Crompton & Knowles Corp.), Mesitol TM NBS (Mobay Corporation), FX-369 (Minnesota Mining & Mfg. Co.), and CB-130 (Grifftex Corp.). Antron Stainmaster TM carpet manufactured by Du Pont contains nylon fibers which have both a fluorocarbon coating and a sulfonated phenol-formaldehyde condensation polymeric coating.

While sulfonated hydroxyaromatic formaldehyde condensation polymeric coatings reduce the staining of polyamide fibers by acid dyes, they have not been successful in imparting resistance to staining by compounds such as mustard with tumeric or hot coffee. Further, although the polymeric coating is colorless when applied, the resins react with ultraviolet light or nitrogen dioxide over time, gradually turning yellow. The yellowing can be severe enough to prevent the use of the stain resistant compositions on light shaded textile articles.

Efforts to overcome the discoloration problem have been described by U.S. Pat. No. 4,780,099 to Greschler, et al., disclosing that yellowing can be reduced by applying phenol formaldehyde condensation stain resistant compositions at pH values of 1.5–2.5, and European Patent Application 87301180.3 by E. I. Du Pont Nemours & Co., disclosing that polyamide fabrics treated with etherified or acylated formaldehyde phenol condensation polymers containing 10–25% $SO_3$ groups and 75–90% $SO_2$ groups have improved resistance to staining as well as discoloration.

While the performance of stain resistant compositions have been improved, none of the stain resistant compositions currently available offer a suitable combination of protection from staining by common household products such as mustard, coffee, and soft drinks, along with adequate resistance to discoloration over time.

It is therefore an object of the present invention to provide a stain resistant composition which protects polyamide carpets, upholstery, and other synthetic and natural fibers from staining.

It is a further object of the present invention to provide a stain resistant composition which does not yellow significantly over time.

It is still another object of the present invention to provide methods for coating natural and synthetic fibers which are effective, versatile, economical and result in products which are resistant to staining by many common household compounds, including coffee, mustard, wine and soft drinks.

It is a still further object of the present invention to provide natural and synthetic fibers coated with these stain resistant compositions which do not discolor significantly over time.

It is yet another object of the present invention to provide a method for preparing a stain resistant composition.

SUMMARY OF THE INVENTION

A stain resistant composition is prepared by polymerizing an $\alpha$-substituted acrylic acid in the presence of a sulfonated aromatic formaldehyde condensation polymer. The stain resistant composition provides superior protection to polyamide fibers from acid dyes, such as those in soft drinks exemplified by red KoolAid TM, mustard with tumeric and coffee, and is resistant to discoloration over time. Polyamide textiles coated with the composition do not discolor when exposed to 20 hours of continuous xenon light.

The composition can be effectively applied to any synthetic or natural fiber having polyamide linkages using a wide variety of means, for example, in a batch or continuous exhaust system, a treat and dry system, or in a tumbler with the polyamide material prior to extrusion. The composition can also be effectively applied as a foam, in a nonionic or anionic detergent, or along with antistatic agents, other water soluble polymers, or in combination with any other stain resistant hydroxyaromatic condensation product.

DETAILED DESCRIPTION OF THE INVENTION

The present invention is a polymeric composition which imparts superior stain resistance to fibers having polyamide linkages. It is prepared by polymerizing an α-substituted acrylic acid in the presence of a sulfonated aromatic formaldehyde condensation polymer. The composition represents a significant advance in stain resisting technology in that it does not discolor significantly over an extended period of time.

The composition can be applied to any fiber containing polyamide linkages. Polyamide linkages are found in a wide variety of fibers and fabrics, such as wool, silk, natural leather, synthetic leather and nylon. Wool is composed primarily of α-keratin, a naturally occurring α-helical fibrous protein. Silk is composed primarily of β-keratin, a naturally occurring fibrous protein existing in a zig-zag structure. Leather is almost pure collagen, a fibrous protein composed primarily of glycine, alanine, proline and 4-hydroxyproline, forming a three stranded helical structure. Nylon is a synthetic polyamide, prepared by the polycondensation of a dicarboxylic acid and a diamine, such as adipic acid and hexamethylene diamine (nylon 6,6). Nylon can also be produced from a cyclic amide such as caprolactam (nylon 6).

The compositions of the present invention are described with reference to specific non-limiting examples. As characterized below, the methods for making these compositions are applicable to a wide variety of starting materials and final products. The following are schematics of exemplary sulfonated hydroxyaromatic condensation polymers suitable for the preparation of the stain resistant composition of the present invention:

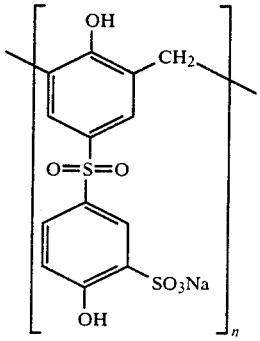

4,4'-Dihydroxydiphenylsulfone formaldehyde condensation polymer

-continued

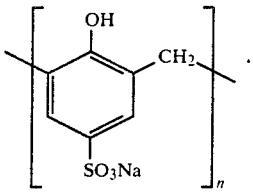

Phenol 4-Sulfonic Acid formaldehyde condensation polymer

Preparation of the Stain Resistant Polymeric Composition

The stain resistant polymeric composition is prepared by polymerizing an α-acrylic acid in the presence of a sulfonated aromatic formaldehyde condensation polymer. Both the carboxylic acid groups on the poly(α-acrylic acid) and the sulfonate groups on the hydroxyaromatic formaldehyde condensation polymer can contribute to the stain resisting properties of the composition by reducing the availability of the protonated amino groups on the polyamide fiber.

Sulfonated Aromatic Formaldehyde Condensation Polymers

The sulfonated aromatic formaldehyde condensation polymer can be synthesized as described below or purchased from commercial sources.

Any sulfonated aromatic compound that will undergo formaldehyde condensation can be used in the preparation of the stain resistant composition. Examples of condensation polymers of 4,4'-dihydroxydiphenylsulfone and phenyl 4-sulfonic acid are illustrated in FIG. 1. Other suitable aromatic compounds include sulfonated derivatives of naphthol, naphthalene, and vinyl aromatics, such as styrene and styrene derivatives.

The sulfonated aromatic formaldehyde resins can be prepared by methods known to those skilled in the art. Methods of preparation of condensation polymers of sulfonated aromatic hydroxy compounds with formaldehyde are provided in U.S. Pat. Nos. 1,901,536 to Schafer, 1,972,754 to Biedermann, 1,988,985 to Schafer, 2,112,361 to Fischer, 2,171,806 to Russell et al., and 4,680,212 to Blythe and Ucci, all incorporated herein by reference.

In general, an aromatic hydroxy compound such as phenol or naphthol is first sulfonated, typically with sulfuric acid. Phenol is sulfonated in the ortho and para positions, with the 4-sulfonic isomer predominating. 1-Naphthol is sulfonated predominately in the 4-position. 2-Naphthol is sulfonated primarily in the 2-position. 4,4'-Dihydroxydiphenylsulfone is sulfonated primarily in the 3'-position.

The sulfonated aromatic compound is then polymerized with formaldehyde under acidic or basic conditions. Alternatively, mixtures of sulfonated aromatic compounds can be polymerized. Typically, in acid, a mole of sulfonated aromatic hydroxy compound is reacted with 0.3 to 0.5 mole of formaldehyde. In a basic medium, a mole of sulfonated aromatic hydroxy compound is reacted with 0.9 to 1.5 mole of formaldehyde. When the polymerization is performed in base, the product has more $CH_2OH$ terminal groups than when prepared in acid, rendering the polymer more water soluble. It is possible to get crosslinking of the growing polymer chains during the polymerization. The extent of crosslinking is limited by steric factors and by adjustment of the curing conditions. Crosslinked phenolic-aldehyde polymers are sometimes referred to as "novolacs".

The sulfonated aromatic condensation polymer can be reacted with a base to form a sulfonic acid salt. Currently marketed stain resistant condensation polymers are typically sold as the sodium sulfonate salt. The condensation polymer can alternatively be used in the form of an ammonium, alkali metal, potassium or other salt, or as the free sulfonic acid.

Sulfonated hydroxyaromatic resins can be purchased commercially, such as CB-130 (Grifftex Corp.), Erinol TM NW (Ciba-Geigy Limited), FX-369 (Minnesota Mining & Mfg. Co.), Gascofix TM NY (Gaston County Dyeing Machine Company), Tamol TM SN (Rohm & Haas Co.), Mesitol TM NBS (Mobay Corporation), Nylofixan TM P (Sandoz Corp.), and Intratex TM N (Crompton & Knowles Corp.). The sulfonated aromatic resins are typically bought as a 30–40% solids aqueous solution, which can contain glycols. Between approximately 30% and 70% of the units of the condensation polymer should be sulfonated. A preferred polymeric composition is completely water soluble and contains approximately 50 mole percent of monosulfonated aromatic units, 15 mole percent of disulfonated aromatics units, and 34 mole percent of unsulfonated aromatic units. It has been determined that stain resistant compositions with sulfonated aromatic resins which contain sulfonated napthalene units have good wear durability, and impart softness to the fiber. α-Substituted acrylic acids ($H_2C{=}C(R)CO_2X$), where R is a hydrocarbon, halogenated hydrocarbon, or sulfonated hydrocarbon from $C_1$ to $C_{15}$, phenol, naphthol, sulfonated phenol, sulfonated naphthol or a halogen, and X is H or a hydroxylated, ethoxylated, sulfonated or halogenated hydrocarbon of $C_1$ to $C_{15}$.

An α-substituted acrylic acid ($H_2C{=}C(R)CO_2X$), where R is a hydrocarbon, halogenated hydrocarbon, or sulfonated hydrocarbon from $C_1$ to $C_{15}$, phenol, naphthol, sulfonated phenol, sulfonated naphthol or a halogen, and X is H or a hydroxylated, ethoxylated, sulfonated or halogenated hydrocarbon of $C_1$ to $C_{15}$, is polymerized in a solution containing the sulfonated aromatic resin to yield the stain resistant composition. Mixtures of the α-substituted acrylic acids can also be reacted together. Esters of substituted acrylic acids can be polymerized in combination with α-substituted acrylic acids. However, if the alcohol from which the ester is prepared is hydrophobic, as the percentage of ester in the composition increases, water solubility and affinity for the polyamide fiber will decrease. If the alcohol from which the ester is prepared is hydrophilic or basic, water solubility is not adversely affected.

It has been discovered that when the α-position of acrylic acid is not substituted, the resulting composition does not impart effective stain resistance to polyamide fibers. This may be a result of the geometric conformation of the poly(acrylic acid). An α-substituted acrylic acid typically has a syndiotactic structure, while an unsubstituted acrylic acid has an isotactic structure. It is believed that the syndiotatic structure of the α-substituted acrylic acid polymer provides a good fit to the structure of nylon, allowing for efficient hydrogen bonding.

The α-substituted acrylic acid is mixed with the sulfonated aromatic resin solution in a ratio ranging from 30:1 to 1:1 of acrylic acid to condensation resin solids, with a preferred ratio of approximately 8:1. For example, 16 grams of glacial methacrylic acid can be mixed with 6 grams of a 30% solids solution of sulfonated condensation resin (1.8 grams of solid).

A free radical chain initiator such as potassium persulfate, ammonium persulfate, or sodium persulfate is added to initiate polymerization. The reaction is heated to approximately 50°–100° C. with stirring for a time ranging from about 30 minutes to 2 hours on a laboratory bench scale, or a time sufficient to react all but less than about 1% monomer. Preferred reaction conditions are at 90° C. for 1 hour. The resulting cooled polymeric solution has an acidic pH, and typically 12–15 grams of solids per 100 grams of solution. If there is over 15 percent solids in the solution, the solution approaches a gel. As the ratio of the α-substituted acrylic acid to resin decreases, the viscosity of the resulting solution decreases. Viscosity can be adjusted with hydrotropes such as sodium xylene sulfonate, sodium cumene sulfonate, sodium toluene sulfonate or sodium dodecyl diphenyl oxide disulfonate.

α-Substituted acrylic acids, free radical initiators, and hydrotopes are commercially available from a variety of sources.

The exact chemical structure of the stain resistant polymeric composition prepared as described above is not known at this time. Since substantially more α-substituted acrylic acid than sulfonated aromatic condensation polymer is used to make the stain resistant composition, it is believed that the composition is predominantly a poly(α-substituted acrylic acid) in association with a lesser amount of condensation polymer. It is also possible that during the free radical polymerization reaction, α-substituted acrylic acid monomers are reacting with functional groups on the condensation polymer, some of which may have been oxidized under the polymerization conditions.

The present invention is further understood with reference to the following non-limiting example.

EXAMPLE 1

Preparation of Composition Containing the Reaction Product of Poly(methacrylic acid) and Sulfonated 4,4'Dihydroxydiphenylsulfone Formaldehyde Condensation Polymer Glacial (99% in water) methacrylic acid (163.8 g; approximately 1.90 moles), water (1156.4 g), formaldehyde condensate of sulfonated 4,4'-dihydroxydiphenylsulfone (61.3 grams of a solution of approximately 30% solids) and potassium persulfate (1.1 g) were mixed in a 2 liter round bottom flask equipped with a mechanical stirrer and hot bath. The resulting brownish solution was heated to approximately 60°–70° C. with stirring, during which time the color changed to yellow. After approximately 45–60 minutes, the polymer began to gel, resulting in a cloudy suspension. The suspension spontaneously began to boil, indicating a large exothermic reaction. The beaker was removed from the hot bath, and stirring was continued in a room temperature water bath until the solution was cooled. The resulting polymeric solution was clear and yellowish and contained approximately 12–15% solids. The pH of a 10% solution of the reaction product is 2.9.

Method of Application of Stain Resistant Composition

The stain resistant composition of the present invention can be applied to dyed or undyed fibers containing polyamide linkages, including synthetic and natural materials such as nylon, wool, silk, and leather, hereinafter referred to collectively as a "polyamide". The composition can be applied to a polyamide in combination with a soil and water resistant fluorochemical, or it can be applied alone. The fluorochemical can be applied to the fiber either before or after treatment with the stain resistant composition.

The stain resistant compositions can be applied to fibers and textile articles by any of the methods known to those skilled in the art for application of textile treating solutions. In one method, polyamide is mixed with polymeric solids in a tumble vat, and then extruded. In another method for application to leather, the composition is applied in a tanning wheel, according to procedures known to those skilled in the art.

Desired performance is balanced with cost effectiveness in determining the amount of the composition to be applied. Application of 1.5–7.0% of the polymer composition based on the weight of the polyamide provides effective stain resistance. The amount of composition to be applied will vary based on many factors known to those skilled in the art, including dyeability of the fiber, crystallinity, and type of substrate.

The following are nonlimiting examples of the batch exhaust, continuous exhaust, treat and dry (batch or continuous) and foam methods for application of the composition.

EXAMPLE 2

Application of the Stain Resistant Product by Batch Exhaust

At least 0.3% solids of stain resistant polymeric composition, based on the weight of the polyamide material, is added to a bath before, during, or after dyeing of polyamide material. The pH is then adjusted to 2.0–2.5 with an acid such as sulfamic, acetic, sulfuric, hydrochloric, formic, or citric acid. The material is allowed to remain in the bath for a time and at a temperature sufficient to exhaust, or deposit, all of the composition onto the polyamide article. The lower the temperature or the higher the pH, the more time is required for exhaustion. The final pH should not exceed 5.5. For example, at a pH of 2.0, a typical exhaustion will take approximately 15 minutes at 160° F. The polyamide material is then cold rinsed and dried.

EXAMPLE 3

Application of the Stain Resistant Product by Continuous Exhaust

An aqueous solution consisting of at least 0.3% solids of the stain resistant composition, based on the weight of the polyamide material, adjusted to a pH of 2.0–2.5 with a suitable acid, is applied to the polyamide via a flood, spray, foam, pad, kiss, or print procedure. The application can be made before, during, or after dyeing of the polyamide material.

The polyamide material is steam treated after application of the material for a time sufficient to "fix" the stain resistant composition onto the polyamide material. For example, a 300% wet pick-up of a 1% solids solution at pH 2.0 is fixed by steaming the polyamide material for 1–2 minutes. The material is then cold water rinsed and dried.

EXAMPLE 4

Application of the Stain Resistant Product by Treat and Dry (Batch or Continuous).

A solution of at least 0.3% solids of the stain resistant composition, based on the weight of polyamide material, adjusted to pH 2.0–5.5 with a suitable acid, is applied by a flood, spray, foam, pad, kiss, or print procedure. The polyamide material is then dried with thermal, steam or electrical heat generation equipment to remove the moisture. The material can also be air dried without heat generation equipment.

EXAMPLE 5

Application of the Stain Resistant Product by Foam Application

The stain resistant composition can be applied as a foam by mixing a suitable amount of a foam generating surfactant, such as ammonium laurel sulfate, with a solution of between 1:1 and 1:10 of stain resistant composition to water. The foam is applied to the polyamide and then heat cured with steam or thermal set equipment. Alternatively, the material can be air dried.

EXAMPLE 6

Application of the Stain Resistant Product by Continuous Application

Laboratory simulation of continuous application of the stain resistant material was conducted as follows.

To simulate the continuous dyeing of carpet, a 30 gram swatch of an unbacked nylon carpet was placed in a microwave dish containing 120 mL of a solution containing 2.0 grams/liter of dioctyl sulfosuccinate (anionic surfactant) and 1.0 grams/liter of an anionic acid dye leveler. The dish was covered with a perforated lid and steamed in a microwave for 3 minutes to remove any tint or dirt. The steamed swatch was then rinsed in cold water.

The mock dyed swatch was then placed in a microwave dish containing 120 mL of a 10 gram/liter solution of the stain resistant composition buffered to a pH of 1.5–3.0 with sulfamic acid, preferably a pH of 2.0. The dish was covered and placed in the microwave for 3 minutes. The swatch was then removed from the heated bath and rinsed in cold water. Good results were observed when the carpet was dried after treatment with the composition.

In another variation of these methods for applying the stain resistant composition, the coated substrate is heated after the stain resistant composition has been applied to the substrate for an amount of time sufficient to crosslink the composition.

In variations of the method for applying the stain resistant composition to fibers containing polyamide linkages, the stain resistant composition is applied in a detergent solution containing nonionic or anionic surfactants, or along with anionic antistatic agents or other water soluble polymers.

The composition can also be used as a flexible polymeric novolac type surface coating, construction insulation material, or electrical insulation product. It can also be used as a base in glue, paints, and molding resins using procedures similar to those known to those skilled in the art for incorporating other novolac type polymers.

EXAMPLE 7

Demonstration of Stain Resistance

The stain resistant composition is effective in protecting nylon, wool, silk, natural leather and synthetic leather from stains resulting from exposure to acid dyes such as those contained in hot coffee and soft drinks.

A particularly difficult acid dye to remove, Food, Drug, and Cosmetic Red Dye No. 40 (Red Dye No. 40), which is found in certain soft drinks, has the following structure.

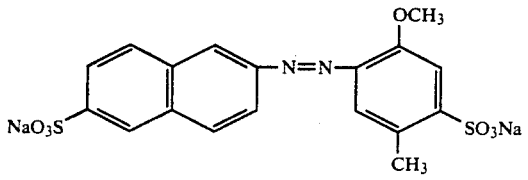

When Red Dye No. 40is spilled on nylon carpet, the sulfonate groups in the dye attach to protonated amines in the nylon, forming an ionic or Van der Waals bond which holds the dye, staining the carpet. Nylon fiber treated with the stain resistant composition resists staining by a liquid containing Red Dye No. 40 for 24 hours at room temperature or for one minute at 160° F.

The stain resistant composition also provides superior protection from mustard with tumeric and coffee, which have historically been more difficult to resist than Red Dye No. 40. For example, the composition inhibits staining from mustard with tumeric or coffee when applied at 160° F. to a 3 inch diameter circle for 30 minutes and then rinsed with cold water.

EXAMPLE 8

Demonstration of Resistance to Discoloration

The stain resistant composition represents a significant advance in stain resistant technology in that it does not discolor significantly over an extended period of time, as demonstrated by the following experiment.

Carpet samples were treated with an equal solids amount at pH 2.0 of NRD 332 (Du Pont Stainmaster TM), Anzo 5 MAK 7 (Allied Chemical Corp.), CB-130 (Grifftex Corp.), FX-369 (Minnesota Mining & Mfg. Co.), and the stain resistant composition of the present invention. All of the carpet samples were exposed to 20 standard fade units of xenon light, and then graded in accordance to the AATCC gray scale for light fastness breaks. The scale, which ranges from 1–5, is a measure of the degree of discoloration, with 5 indicative of no discoloration or color break.

The results demonstrate the superiority of the stain resistant composition of the present invention.

| Composition | Degree of Discoloration |
|---|---|
| α-Acrylic acid-sulfonated hydroxyaromatic composition | 5 |
| DuPont ND 332 | 3 |
| Allied Anzo 5 MAK 7 | 3–4 |
| Grifftex CB-130 | 3–4 |
| 3M FX-369 | 3–4 |

Modifications and variations of the present invention, a method and compositions for increasing stain resistance of fibers having polyamide linkages, will be obvious to those skilled in the art from the foregoing detailed description. Such modifications and variations are intended to come within the scope of the appended claims.

We claim:

1. A stain resistant carpet comprising:

(i) fibers containing polyamide linkages; and (ii) a polymeric composition applied to the fibers that is prepared by polymerizing $H_2C{=}C(R)CO_2X$, where R is a hydrocarbon, halogenated hydrocarbon, or sulfonated hydrocarbon of from $C_1$ to $C_{15}$, phenol, naphthol, sulfonated phenol, sulfonated naphthol or a halogen, and X is H or a hydroxylated, ethoxylated, sulfonated, or halogenated hydrocarbon of $C_1$ to $C_{15}$, in the presence of a sulfonated aromatic formaldehyde condensation polymer.

2. The carpet of claim 1 wherein the ratio of grams of $H_2C{=}C(R)CO_2X$ to grams of condensation polymer in the polymerization mixture is between approximately 30:1 to 1:1.

3. The carpet of claim 1 wherein the ratio of grams of $H_2C{=}C(R)CO_2X$ to grams of condensation polymer in the polymerization mixture is approximately 8:1.

4. The carpet of claim 1 wherein R is selected from the group consisting of methyl, ethyl, propyl, butyl, phenyl, phenol, sulfonated phenol, naphthol, chloro, and fluoro.

5. The carpet of claim 1 wherein X is hydrogen.

6. The carpet of claim 5 wherein the aromatic moiety in the condensation polymer is selected from the group consisting of phenyl, phenol, naphthol, napthalene, and 4,4'-dihydroxydiphenylsulfone.

7. The carpet of claim 1 wherein between approximately 30% and 70% of the units of the condensation polymer are sulfonated.

8. The carpet of claim 1 wherein the polyamide fibers are selected from the group consisting of nylon, wool, silk, natural leather, and synthetic leather.

9. The carpet of claim 1 wherein the polymeric product is applied to the polyamide in an amount of at least 2.0 grams of polymeric product per 100 grams of polyamide article.

10. A method of preparing a stain resistant carpet comprising applying to fibers containing polyamide linkages a stain resistant composition prepared by polymerizing $H_2C{=}C(R)CO_2X$, wherein R is a hydrocarbon, halogenated hydrocarbon, or sulfonated hydrocarbon of from $C_1$ to $C_{15}$, phenol, naphthol, sulfonated phenol, sulfonated naphthol or a halogen, and X is H or a hydroxylated, ethoxylated, sulfonated or halogenated hydrocarbon of $C_1$ to $C_{15}$ in the presence of a sulfonated aromatic formaldehyde condensation polymer.

11. The method of claim 10 further comprising initiating the polymerization with a free radical producing agent.

12. The method of claim 11 wherein the free radical producing agent is selected from the group consisting of potassium persulfate, ammonium persulfate, and sodium persulfate.

13. The method of claim 10 further comprising polymerizing the $H_2C{=}C(R)CO_2X$ at a temperature of between 50° C. and 100° C.

14. The method of claim 10 further comprising polymerizing the $H_2C{=}C(R)CO_2X$ until less than 1% monomer remains.

15. The method of claim 10 further comprising providing a ratio of grams of $H_2C{=}C(R)CO_2X$ to grams of condensation polymer solids in the polymerization mixture of between approximately 30:1 and 1:1.

16. The method of claim 15 wherein the ratio of grams of $H_2C{=}C(R)CO_2H$ to grams of condensation polymer solids in the polymerization mixture is approximately 8:1.

17. The method of claim 10 further comprising selecting R from the group consisting of methyl, ethyl, propyl, butyl, phenyl, phenol, naphthol, sulfonated naphthol, sulfonated phenol, fluoro, and chloro.

18. The method of claim 10, further comprising selecting X as H.

19. The method of claim 18 further comprising selecting the hydroxyaromatic from the group consisting of phenyl, phenol, naphthol, napthalene, and 4,4'-dihydroxydiphenylsulfone.

20. The method of claim 10 further comprising providing between approximately 30% and 70% sulfonated units in the condensation polymer.

21. The method of claim 10 further comprising selecting the polyamide fibers from the group consisting of nylon, wool, silk, natural leather, and synthetic leather.

22. The method of claim 10 wherein the fibers are nylon further comprising applying the stain resistant composition before extrusion of the polyamide fibers.

23. The method of claim 10 further comprising applying the stain resistant composition in combination with a compound selected from the group consisting of anionic surfactant, nonionic surfactants, and antistatic agents.

24. The method of claim 10 further comprising applying the composition in combination with a foam generating surfactant.

25. The method of claim 10 further comprising selecting ammonium laurel sulfate as the surfactant.

26. The method of claim 10 further comprising applying the composition to dyed fiber.

27. The method of claim 10 further comprising applying the composition to undyed fiber.

28. The method of claim 10 further comprising applying a fluorochemical coating.

29. The method of claim 10 further comprising applying the composition by batch exhaust.

30. The method of claim 10 further comprising applying the composition by continuous exhaust.

31. The method of claim 10 further comprising applying the composition by heat and dry.

32. The method of claim 10 further comprising applying between approximately 1.5 and 7.0% of the polymer composition based on the weight of the fiber.

33. The carpet of claim 1 further comprising a fluorochemical coating.

34. The carpet of claim 1 comprising between approximately 1.7 and 7.0% of polymer composition based on the weight of the fiber.

* * * * *